US009416478B2

(12) United States Patent
Kim et al.

(10) Patent No.: US 9,416,478 B2
(45) Date of Patent: Aug. 16, 2016

(54) WASHING MACHINE AND WASHING METHOD

(75) Inventors: Woo Young Kim, Seoul (KR); Soo Young Oh, Seoul (KR); Kyeong Hwan Kim, Seoul (KR); Jae Won Chang, Seoul (KR); Kyung Chul Woo, Seoul (KR); Byung Keol Choi, Seoul (KR); Myong Hun Im, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 440 days.

(21) Appl. No.: 12/749,760

(22) Filed: Mar. 30, 2010

(65) Prior Publication Data

US 2010/0242186 A1 Sep. 30, 2010

(30) Foreign Application Priority Data

Mar. 31, 2009 (KR) ..... 10-2009-0027664
Sep. 15, 2009 (KR) ..... 10-2009-0087141

(51) Int. Cl.

| | |
|---|---|
| ***D06F 35/00*** | (2006.01) |
| ***D06F 23/02*** | (2006.01) |
| ***D06F 33/02*** | (2006.01) |
| ***D06F 39/08*** | (2006.01) |
| ***D06F 39/00*** | (2006.01) |

(52) U.S. Cl.

CPC ..... *D06F 35/006* (2013.01); *D06F 23/02* (2013.01); *D06F 33/02* (2013.01); *D06F 39/003* (2013.01); *D06F 39/088* (2013.01)

(58) Field of Classification Search

CPC ..... D06F 23/02; D06F 35/006; D06F 33/02; D06F 39/003; D06F 39/088

USPC ..... 8/159; 68/12.06, 12.12, 140, 24, 58, 68/131

See application file for complete search history.

(56) References Cited

U.S. PATENT DOCUMENTS

| | | | | |
|---|---|---|---|---|
| 2,432,766 | A | 12/1947 | Kirby | 68/19 |
| 2,540,717 | A * | 2/1951 | Diether | 68/12.24 |
| 2,556,490 | A | 6/1951 | Chamberlin | |
| 2,942,447 | A | 6/1960 | Rickel et al. | |
| 3,387,310 | A | 6/1968 | Marshall | |
| 3,388,410 | A * | 6/1968 | Marshall | 8/158 |
| 3,811,300 | A * | 5/1974 | Barton et al. | 68/12.19 |

(Continued)

FOREIGN PATENT DOCUMENTS

| | | |
|---|---|---|
| CN | 1300892 A | 6/2001 |
| CN | 1070953 C | 9/2001 |

(Continued)

OTHER PUBLICATIONS

Front Loading Automatic Washer, Use and Care Guide [online] Maytag Aug. 18, 2006; [retrieved on Sep. 2, 2011]; Retrieved from the Internet: <URL:http: / /dl.owneriq.net/1/11ea371b-d431-44f5-8002-03a5d6ab459.pdf>; pp. 1-72.

(Continued)

*Primary Examiner* — Joseph L Perrin
(74) *Attorney, Agent, or Firm* — Ked & Associates, LLP

(57) ABSTRACT

A washing machine and an associated washing method are provided. The method may include supplying washing fluid into a drum containing laundry, repeatedly dropping the laundry while rotating the drum in a predetermined direction, and drawing the laundry towards or separating the laundry from the inner circumferential surface of the drum by repeatedly accelerating and decelerating the drum.

19 Claims, 6 Drawing Sheets

(56) References Cited

U.S. PATENT DOCUMENTS

| | | | | |
|---|---|---|---|---|
| 4,489,574 | A | 12/1984 | Spendel | 68/16 |
| 4,916,768 | A * | 4/1990 | Broadbent | 8/159 |
| 5,191,668 | A | 3/1993 | Euler et al. | 8/158 |
| 5,219,370 | A | 6/1993 | Farrington et al. | |
| 5,335,524 | A * | 8/1994 | Sakane | 68/12.04 |
| 5,560,061 | A * | 10/1996 | Wentzlaff et al. | 8/159 |
| 5,758,377 | A * | 6/1998 | Cimetta et al. | 8/158 |
| 5,768,730 | A | 6/1998 | Matsumoto et al. | |
| 5,813,069 | A | 9/1998 | Kim | 8/159 |
| 5,870,905 | A | 2/1999 | Imamura et al. | 68/12.04 |
| 6,023,854 | A | 2/2000 | Tsunomoto et al. | |
| 6,029,299 | A | 2/2000 | Baek et al. | |
| 6,158,072 | A | 12/2000 | Baek et al. | |
| 6,401,284 | B1 | 6/2002 | Jeon et al. | |
| 6,460,382 | B1 | 10/2002 | Kim et al. | |
| 7,127,767 | B2 | 10/2006 | McAllister et al. | 8/159 |
| 7,146,669 | B2 | 12/2006 | Orszulik | |
| 7,331,075 | B2 * | 2/2008 | Lee et al. | 8/159 |
| 7,478,547 | B2 * | 1/2009 | Okazaki et al. | 68/12.04 |
| 7,490,490 | B2 | 2/2009 | Hirasawa et al. | 68/12.04 |
| 7,530,133 | B2 * | 5/2009 | Mitts | 8/159 |
| RE40,732 | E | 6/2009 | Jeon et al. | |
| 7,568,366 | B2 | 8/2009 | Chang et al. | |
| 7,739,765 | B2 | 6/2010 | Ashrafzadeh et al. | |
| 2001/0054203 | A1 | 12/2001 | Bringewatt et al. | |
| 2003/0020431 | A1 | 1/2003 | Kiuchi et al. | 318/779 |
| 2003/0089139 | A1 | 5/2003 | Orszulik | |
| 2003/0208852 | A1 | 11/2003 | Hardaway et al. | 8/158 |
| 2003/0208855 | A1 | 11/2003 | McAllister et al. | 8/159 |
| 2004/0148710 | A1 | 8/2004 | Kim | |
| 2004/0158933 | A1 | 8/2004 | Seo et al. | |
| 2004/0194226 | A1 | 10/2004 | Kim et al. | |
| 2005/0016227 | A1 | 1/2005 | Lee | |
| 2005/0044641 | A1 | 3/2005 | Hyeong | |
| 2005/0050646 | A1 | 3/2005 | Lee et al. | |
| 2005/0066999 | A1 | 3/2005 | Dietz et al. | 134/18 |
| 2005/0120492 | A1 | 6/2005 | Koo et al. | |
| 2005/0160536 | A1 | 7/2005 | McAllister et al. | 8/137 |
| 2005/0223504 | A1 | 10/2005 | Lee et al. | |
| 2005/0268669 | A1 | 12/2005 | Ko et al. | |
| 2005/0268670 | A1 | 12/2005 | Hirasawa et al. | 68/12.06 |
| 2005/0284192 | A1 | 12/2005 | Altinier et al. | |
| 2006/0021392 | A1 | 2/2006 | Hosoito et al. | |
| 2006/0048548 | A1 | 3/2006 | Park et al. | |
| 2006/0112496 | A1 | 6/2006 | Kim | |
| 2006/0185095 | A1 | 8/2006 | Mitts | |
| 2007/0006394 | A1 | 1/2007 | Chang et al. | |
| 2007/0017262 | A1 | 1/2007 | McAllister et al. | |
| 2007/0124871 | A1 | 6/2007 | Kwon et al. | |
| 2007/0130700 | A1 | 6/2007 | Cho et al. | |
| 2007/0283507 | A1 | 12/2007 | Wong et al. | |
| 2008/0083132 | A1 | 4/2008 | Schaub et al. | 34/318 |
| 2008/0172804 | A1 | 7/2008 | Vanhazebrouck et al. | |
| 2008/0196172 | A1 | 8/2008 | Jeong | |
| 2008/0201867 | A1 | 8/2008 | Bang et al. | |
| 2008/0201868 | A1 | 8/2008 | Bang et al. | |
| 2008/0222818 | A1 | 9/2008 | Yun et al. | |
| 2008/0250824 | A1 | 10/2008 | Oh et al. | 68/5 |
| 2008/0276382 | A1 | 11/2008 | Benne et al. | |
| 2008/0289118 | A1 * | 11/2008 | Park et al. | 8/159 |
| 2008/0297098 | A1 | 12/2008 | Hollenbeck et al. | |
| 2009/0019896 | A1 | 1/2009 | Kim et al. | |
| 2009/0100608 | A1 | 4/2009 | Lee et al. | |
| 2009/0126222 | A1 | 5/2009 | Bae et al. | |
| 2009/0183319 | A1 | 7/2009 | Chai et al. | |
| 2009/0199350 | A1 | 8/2009 | Fechler et al. | |
| 2009/0249838 | A1 | 10/2009 | Kim et al. | |
| 2009/0249840 | A1 | 10/2009 | Jo et al. | 68/5 |
| 2010/0005680 | A1 | 1/2010 | Kim et al. | |
| 2010/0162586 | A1 | 7/2010 | Lee | |
| 2010/0205753 | A1 | 8/2010 | Kim et al. | |

FOREIGN PATENT DOCUMENTS

| | | | |
|---|---|---|---|
| CN | 1521305 | | 8/2004 |
| CN | 1521311 | A | 8/2004 |
| CN | 1534128 | | 10/2004 |
| CN | 1580374 | | 2/2005 |
| CN | 1609331 | | 4/2005 |
| CN | 1637197 | A | 7/2005 |
| CN | 1680648 | | 10/2005 |
| CN | 1782191 | | 6/2006 |
| CN | 101046046 | | 10/2007 |
| CN | 101168894 | | 4/2008 |
| CN | 101397745 | | 4/2009 |
| CN | 101517141 | | 8/2009 |
| CN | 101532234 | | 9/2009 |
| CN | 10182787 | | 8/2010 |
| CN | 101812790 | | 8/2010 |
| DE | 24 16 518 | A1 | 10/1975 |
| DE | 196 19 603 | A1 | 11/1997 |
| DE | 198 32 292 | A1 | 1/2000 |
| DE | 102 34 473 | | 2/2004 |
| DE | 103 26 551 | | 1/2005 |
| DE | 10-2005-003695 | | 7/2006 |
| EP | 0 247 421 | A2 | 12/1987 |
| EP | 0 399 406 | A2 | 11/1990 |
| EP | 0 465 885 | A1 | 1/1992 |
| EP | 0 542 137 | | 5/1993 |
| EP | 0 618 323 | A1 | 10/1994 |
| EP | 0 629 733 | A1 | 12/1994 |
| EP | 0 704 567 | A1 | 4/1996 |
| EP | 0742307 | | 11/1996 |
| EP | 0 781 881 | | 7/1997 |
| EP | 0 796 942 | A2 | 9/1997 |
| EP | 1 116 812 | | 7/2001 |
| EP | 1 164 217 | A1 | 12/2001 |
| EP | 1 380 682 | A2 | 1/2004 |
| EP | 1 428 925 | | 6/2004 |
| EP | 1447468 | | 8/2004 |
| EP | 1 524 357 | A2 | 4/2005 |
| EP | 1 555 338 | | 7/2005 |
| EP | 1 555 340 | | 7/2005 |
| EP | 1 612 316 | A1 | 1/2006 |
| EP | 1 619 286 | A2 | 1/2006 |
| EP | 1 634 985 | A1 | 3/2006 |
| EP | 1 788 138 | | 5/2007 |
| EP | 1 983 088 | A1 | 10/2008 |
| EP | 1 995 366 | A1 | 11/2008 |
| EP | 2 042 638 | A1 | 4/2009 |
| EP | 2 080 832 | A1 | 7/2009 |
| EP | 2 090 686 | | 8/2009 |
| EP | 2 103 726 | A | 9/2009 |
| EP | 1 111 117 | A1 | 6/2011 |
| FR | 2 103 369 | | 4/1972 |
| FR | 2 921 079 | | 3/2009 |
| GB | 1329544 | A | 9/1973 |
| GB | 2253215 | | 9/1992 |
| GB | 2 269 395 | A | 2/1994 |
| GB | 2 325 245 | | 11/1998 |
| JP | 58-130089 | | 8/1983 |
| JP | S59-36240 | | 10/1984 |
| JP | 64-020897 | * | 1/1989 |
| JP | 01-288596 | | 11/1989 |
| JP | H 05-184769 | A | 7/1993 |
| JP | 05-212189 | A | 8/1993 |
| JP | 8-266776 | | 10/1996 |
| JP | 09-239189 | A | 9/1997 |
| JP | 09-276582 | A | 10/1997 |
| JP | 10-201991 | | 8/1998 |
| JP | 10-216390 | | 8/1998 |
| JP | H 10-328468 | A | 12/1998 |
| JP | 2000-254385 | A | 9/2000 |
| JP | 2001-009188 | A | 1/2001 |
| JP | 2001-046779 | A | 2/2001 |
| JP | 2001-095935 | A | 4/2001 |
| JP | 2001-224886 | | 8/2001 |
| JP | 2001-232091 | | 8/2001 |
| JP | 2002-119796 | | 4/2002 |
| JP | 2002-153696 | A | 5/2002 |
| JP | 2002-282587 | A | 10/2002 |

(56) References Cited

FOREIGN PATENT DOCUMENTS

| | | | |
|---|---|---|---|
| JP | 2004-057821 | | 2/2004 |
| JP | 2004-081652 | | 3/2004 |
| JP | 2005-124764 | | 5/2005 |
| JP | 2005-131117 | A | 5/2005 |
| JP | 2005-152309 | A | 6/2005 |
| JP | 2005-296631 | A | 10/2005 |
| JP | 2006-068193 | | 3/2006 |
| JP | 2006-239142 | A | 9/2006 |
| JP | 2006-247367 | A | 9/2006 |
| JP | 2007-54416 | | 3/2007 |
| JP | 2007-068804 | A | 3/2007 |
| JP | 2007-117140 | A | 5/2007 |
| JP | 2007-117377 | A | 5/2007 |
| JP | 2007-175528 | A | 7/2007 |
| JP | 2008-049270 | A | 3/2008 |
| JP | 2008-054826 | A | 3/2008 |
| JP | 2008-073128 | | 4/2008 |
| JP | 4100576 | B1 | 6/2008 |
| JP | 2008-194255 | A | 8/2008 |
| JP | 2008-194256 | A | 8/2008 |
| JP | 2008-194257 | | 8/2008 |
| JP | 2008-194258 | A | 8/2008 |
| JP | 2008-220620 | A | 9/2008 |
| JP | 2009-077747 | A | 4/2009 |
| JP | 2009-160327 | A | 7/2009 |
| JP | 2009-213800 | A | 9/2009 |
| KR | 10-1996-0034548 | A | 10/1996 |
| KR | 10-1998-0060338 | | 10/1998 |
| KR | 10-1999-0015909 | | 3/1999 |
| KR | 10-0205411 | | 4/1999 |
| KR | 10-0219267 | | 6/1999 |
| KR | 20-0154059 | Y1 | 8/1999 |
| KR | 10-0220275 | B1 | 9/1999 |
| KR | 10-0245429 | | 11/1999 |
| KR | 10-2001-0004704 | | 1/2001 |
| KR | 2001004704 | * | 1/2001 |
| KR | 10-2001-0012681 | A1 | 12/2001 |
| KR | 10-0315812 | | 12/2001 |
| KR | 10-2002-0010339 | A | 2/2002 |
| KR | 10-2003-0004707 | A | 1/2003 |
| KR | 10-2003-0049822 | A | 6/2003 |
| KR | 10-2004-0046081 | | 6/2004 |
| KR | 10-2004-0058999 | A | 7/2004 |
| KR | 10-2004-0073782 | A | 8/2004 |
| KR | 10-2004-0110973 | A | 12/2004 |
| KR | 10-0653767 | B1 | 12/2004 |
| KR | 10-2005-0000593 | A | 1/2005 |
| KR | 10-2005-0015687 | A | 2/2005 |
| KR | 10-2005-0017490 | A | 2/2005 |
| KR | 10-2005-0022209 | A | 3/2005 |
| KR | 10-2005-0039624 | A | 4/2005 |
| KR | 10-2005-0061701 | A | 6/2005 |
| KR | 10-0511290 | | 6/2005 |
| KR | 10-0504501 | | 7/2005 |
| KR | 10-2005-0093260 | | 9/2005 |
| KR | 10-2005-0097755 | A | 10/2005 |
| KR | 10-2005-0098522 | | 10/2005 |
| KR | 10-0531333 | B1 | 11/2005 |
| KR | 10-2005-0115764 | A | 12/2005 |
| KR | 10-2005-0121052 | A | 12/2005 |
| KR | 10-2006-0001154 | A | 1/2006 |
| KR | 10-2006-0008111 | | 1/2006 |
| KR | 10-2006-0023067 | A | 3/2006 |
| KR | 10-2006-0042636 | | 5/2006 |
| KR | 10-0576282 | | 5/2006 |
| KR | 10-2006-0064119 | | 6/2006 |
| KR | 10-0630225 | B1 | 10/2006 |
| KR | 10-2006-0117528 | A | 11/2006 |
| KR | 10-2006-0120934 | A | 11/2006 |
| KR | 10-0651977 | B1 | 11/2006 |
| KR | 10-2006-0124219 | A | 12/2006 |
| KR | 10-2006-0124224 | | 12/2006 |
| KR | 10-2007-0001607 | | 1/2007 |
| KR | 10-2007-0001611 | A | 1/2007 |
| KR | 10-2007-0018613 | A | 2/2007 |
| KR | 10-2007-0034901 | A | 3/2007 |
| KR | 10-2007-0038729 | A | 4/2007 |
| KR | 10-2007-0040617 | | 4/2007 |
| KR | 10-0719845 | B1 | 5/2007 |
| KR | 10-2007-0063658 | A | 6/2007 |
| KR | 10-2007-0073136 | A | 7/2007 |
| KR | 10-0737452 | | 7/2007 |
| KR | 10-0739612 | B1 | 7/2007 |
| KR | 10-0740065 | B1 | 7/2007 |
| KR | 10-0740841 | | 7/2007 |
| KR | 10-2007-0089536 | A | 8/2007 |
| KR | 10-0751780 | B1 | 8/2007 |
| KR | 10-2007-0101732 | A | 10/2007 |
| KR | 10-2007-0120326 | | 12/2007 |
| KR | 10-2008-0010589 | A | 1/2008 |
| KR | 10-2008-0010593 | | 1/2008 |
| KR | 10-2008-0015300 | A | 2/2008 |
| KR | 10-2008-0018450 | | 2/2008 |
| KR | 10-2008-0041143 | A | 5/2008 |
| KR | 10-2008-0045996 | | 5/2008 |
| KR | 10-2008-0057711 | A | 6/2008 |
| KR | 10-2008-0057723 | A | 6/2008 |
| KR | 10-2008-0069857 | A | 7/2008 |
| KR | 10-2008-0070275 | A | 7/2008 |
| KR | 10-2008-0073451 | | 8/2008 |
| KR | 10-2008-0079458 | A | 9/2008 |
| KR | 10-2008-0084363 | | 9/2008 |
| KR | 10-0857797 | | 9/2008 |
| KR | 10-2008-0087597 | A | 10/2008 |
| KR | 10-2008-0094290 | A | 10/2008 |
| KR | 10-2008-0107097 | A | 12/2008 |
| KR | 10-2009-0013354 | A | 2/2009 |
| KR | 10-2009-0037860 | A | 4/2009 |
| KR | 10-2009-0080608 | | 7/2009 |
| KR | 10-2009-0080821 | A | 7/2009 |
| KR | 10-2009-0085749 | A | 8/2009 |
| KR | 10-2009-0107223 | | 10/2009 |
| KR | 10-2010-0014052 | A | 2/2010 |
| KR | 10-2010-0028920 | A | 3/2010 |
| KR | 10-2010-0091721 | A | 8/2010 |
| KR | 10-0984583 | B1 | 9/2010 |
| KR | 10-2011-0016314 | A | 2/2011 |
| KR | 10-2011-0016330 | A | 2/2011 |
| KR | 10-1012594 | B1 | 2/2011 |
| RU | 2 089 691 | C1 | 9/1997 |
| RU | 2 096 546 | C1 | 11/1997 |
| RU | 2123550 | | 12/1998 |
| RU | 2006145871 | A | 2/2006 |
| RU | 2005122725 | A | 1/2007 |
| RU | 2 293 806 | C2 | 2/2007 |
| RU | 2339751 | | 11/2008 |
| RU | 2 398 059 | C1 | 8/2010 |
| SU | 242774 | | 4/1969 |
| SU | 1043207 | A | 9/1983 |
| SU | 1694744 | A1 | 11/1991 |
| TW | 200840905 | | 10/2008 |
| TW | 200840906 | | 10/2008 |
| WO | WO 98/29594 | | 7/1998 |
| WO | WO 01/59196 | | 8/2001 |
| WO | WO 2006/009380 | | 1/2006 |
| WO | WO 2008/030066 | A2 | 3/2008 |
| WO | WO 2008/069607 | A1 | 6/2008 |
| WO | WO 2008/075987 | A2 | 6/2008 |
| WO | WO 2008/099547 | A1 | 8/2008 |
| WO | WO 2008/099548 | A1 | 8/2008 |
| WO | WO 2008/099549 | | 8/2008 |
| WO | WO 2008/123695 | A2 | 10/2008 |
| WO | WO 2009/017361 | A2 | 2/2009 |
| WO | WO 2009/112222 | | 9/2009 |
| WO | WO 2011/053097 | | 5/2011 |

OTHER PUBLICATIONS

PCT International Search Report and Written Opinion dated Feb. 25, 2011 issued in Application No. PCT/KR2010/005255.

PCT International Search Report dated Jul. 4, 2011 issued in Application No. PCT/KR2010/006991.

International Search Report issued in PCT/KR2009/005094 dated May 7, 2010.

(56) References Cited

OTHER PUBLICATIONS

European Search Report dated Dec. 4, 2009.
International Search Report issue in PCT/KR2010/000884 dated Sep. 28, 2010.
International Search Report dated Aug. 16, 2011 (PCT/KR2010/007670).
International Search Report dated Sep. 21, 2011 (PCT/KR2011/000904).
Korean Notice of Allowance dated Sep. 21, 2011 (Application No. 10-2009-0087141) with English Translation.
International Search Report dated Dec. 7, 2011 issued in Application No. PCT/KR2010/007672.
International Search Report dated Dec. 22, 2011 issued in Application No. PCT/KR2010/007673.
Korean Office Action issued in Application No. 10-2009-0087141 dated May 13, 2011 (full Korean text and full English translation).
Korean Office Action issued in Application No. 10-2009-0073978 dated Jun. 24, 2011 (full Korean text and English translation).
Korean Notice of Allowance issued in Application No. 10-2009-0087141 dated Sep. 21, 2011 (full Korean text and full English translation).
Korean Notice of Allowance issued in Application No. 10-2009-0073978 dated Sep. 27, 2011 (full Korean text and English translation).
International Search Report dated Feb. 25, 2011 issued in Application No. PCT/KR2010/005807.
Chinese Office Action dated Mar. 2, 2011 issued in Application No. 200910171046.9.
Korean Office Action dated May 31, 2011 issued in Application No. 10-2008-0087871.
Korean Office Action dated May 31, 2011 issued in Application No. 10-2009-0073976.
PCT International Search Report and Written Opinion dated Nov. 30, 2010 issued in Application No. PCT/KR2010/001992.
PCT International Search Report and Written Opinion dated Jan. 24, 2011 issued in Application No. PCT/KR2010/05266.
PCT International Search Report and Written Opinion dated Jan. 24, 2011 issued in Application No. PCT/KR2010/05258.
PCT International Search Report and Written Opinion dated Jan. 31, 2011 issued in Application No. PCT/KR2010/05257.
PCT International Search Report and Written Opinion dated Jan. 31, 2011 issued in Application No. PCT/KR2010/05260.
International Search Report dated Apr. 8, 2011. (Application No. PCT/KR2010/06999).
International Search Report dated Apr. 26, 2011. (Application No. PCT/KR2010/07664).
Korean Office Action dated May 13, 2011. (Application No. 10-2009-0087141).
Mexican Office Action dated Aug. 21, 2012 issued in Application No. MX/a/2011/010211 (with English Translation).
Chinese Office Action dated Sep. 5, 2012 issued in Application No. 201080005759.9 (with English Translation).
European Search Report dated Sep. 21, 2012 issued in Application No. 09 009 792.4.
United States Office Action issued in U.S. Appl. No. 12/509,693 dated Oct. 24, 2012.
United States Office Action issued in U.S. Appl. No. 13/420,839 dated Nov. 14, 2012.
Russian Office Action issued in RU Application No. 2011132395 dated Jul. 3, 2012.
Chinese Office Action issued in CN Application No. 2010-80019657 dated Dec. 5, 2012.
U.S. Office Action issued in U.S. Appl. No. 12/509,682 dated Dec. 13, 2012.
United States Office Action dated Jul. 25, 2012 issued in U.S. Appl. No. 13/420,839.
United States Office Action dated Sep. 7, 2012 issued in U.S. Appl. No. 12/509,682.
United States Office Action dated Sep. 7, 2012 issued in U.S. Appl. No. 13/420,819.
Chinese Office Action dated Jan. 6, 2013 (with English translation).
U.S. Office Action issued in U.S. Appl. No. 13/420,819 dated Feb. 1, 2013.
Taiwan Office Action dated Jan. 23, 2013. (with translation).
Australian Office Action dated Jan. 29, 2013.
U.S. Office Action issued in U.S. Appl. No. 12/902,396 dated Mar. 7, 2013.
U.S. Office Action issued in U.S. Appl. No. 12/509,693 dated Apr. 2, 2013.
U.S. Office Action issued in U.S. Appl. No. 12/902,396 dated Jun. 14, 2013.
Chinese Office Action dated Apr. 2, 2014.
U.S. Office Action issued in U.S. Appl. No. 12/509,693 dated Jun. 5, 2014.
Russian Office Action dated May 22, 2013 issued in Application No. 2012111656 (with English translation).
Russian Notice of Allowance dated Jun. 3, 2013 issued in Application No. 2011147906 (with English translation).
Russian Notice of Allowance dated Jul. 1, 2013 issued in Application No. 2011146523 (with English translation).
Russian Office Action dated Jul. 9, 2013 issued in Application No. 2011147901 (with English translation).
U.S. Office Action issued in U.S. Appl. No. 12/509,693 dated Jul. 17, 2013.
Russian Decision to Grant a Patent dated Jul. 19, 2013 issued in Application No. 2012111656 (with English translation).
Taiwanese Office Action dated Sep. 11, 2013 issued in Application No. 099126791 (with English translation).
United States Office Action dated Oct. 2, 2013 issued in U.S. Appl. No. 12/854,372.
Russian Decision to Grant a Patent dated Oct. 9, 2013 issued in Application No. 2011146527 (with English translation).
United States Office Action dated Oct. 22, 2013 issued in U.S. Appl. No. 12/854,346.
United States Office Action dated Oct. 23, 2013 issued in U.S. Appl. No. 12/854,263.
United States Office Action dated Oct. 23, 2013 issued in U.S. Appl. No. 12/854,330.
United States Final Office Action dated Oct. 28, 2013 issued in U.S. Appl. No. 12/509,693.
U.S. Notice of Allowance issued in U.S. Appl. No. 13/420,839 dated Dec. 23, 2013.
U.S. Office Action issued in U.S. Appl. No. 12/938,110 dated Dec. 30, 2013.
U.S. Final Office Action issued in U.S. Appl. No. 12/509,682 dated Jan. 13, 2014.
U.S. Notice of Allowance issued in U.S. Appl. No. 12/854,372 dated Jan. 27, 2014.
U.S. Final Office Action issued in U.S. Appl. No. 12/854,263 dated Feb. 20, 2014.
U.S. Notice of Allowance issued in U.S. Appl. No. 12/853,346 dated Feb. 20, 2014.
U.S. Office Action issued in U.S. Appl. No. 12/854,330 dated Feb. 21, 2014.
U.S. Office Action issued in U.S. Appl. No. 12/509,693 dated Feb. 21, 2014.
U.S. Office Action issued in U.S. Appl. No. 12/938,078 dated Feb. 28, 2014.
Chinese Office Action dated Feb. 20, 2014. (translation).
Chinese Office Action dated Mar. 19, 2014. (translation).
U.S. Office Action issued in U.S. Appl. No. 12/938,135 dated Mar. 31, 2014.
U.S. Office Action issued in U.S. Appl. No. 12/902,300 dated Apr. 11, 2014.
U.S. Office Action issued in U.S. Appl. No. 12/938,110 dated Apr. 21, 2014.
Chinese Office Action dated Jul. 19, 2013 issued in Application No. 201080019658.7 (with English translation).
Japanese Office Action dated Jul. 26, 2013 issued in Application No. 2012-534107.
Taiwanese Office Action dated Aug. 8, 2013 issued in Application No. 099126789 (with English translation).
U.S. Action issued in U.S. Appl. No. 12/902,396 dated Sep. 24, 2013.

(56) References Cited

OTHER PUBLICATIONS

U.S. Action issued in U.S. Appl. No. 12/509,682 dated Sep. 27, 2013.
United States Office Action dated Jul. 21, 2014 issued in U.S. Appl. No. 12/902,300.
United States Office Action dated Jul. 31, 2014 issued in U.S. Appl. No. 12/509,682.
United States Office Action dated Aug. 22, 2014 issued in U.S. Appl. No. 12/938,110.
United States Final Office Action dated Sep. 2, 2014 issued in U.S. Appl. No. 12/938,078.
United States Final Office Action dated Sep. 9, 2014 issued in U.S. Appl. No. 12/938,135.
United States Office Action dated. Sep. 19, 2014 issued in U.S. Appl. No. 12/938,034.
United States Office Action dated Sep. 24, 2014 issued U.S. Appl. No. 12/509,69.
United States Final Office Action dated Oct. 6, 2014 issued in U.S. Appl. No. 12/854,330.
United States Final Office Action dated Oct. 10, 2014 issued in U.S. Appl. No. 12/854,263.
United States Notice of Allowance dated Oct. 20, 2014 issued in U.S. Appl. No. 13/420,819.
European Search Report dated Oct. 16, 2014. (Full English Text).
European Search Report dated Nov. 13, 2014. (Full English Text).
United States Office Action dated Dec. 11, 2014 issued in U.S. Appl. No. 12/509,682.
United States Office Action dated Jan. 5, 2015 issued in U.S. Appl. No. 13/392,597.
United States Office Action dated Feb. 9, 2015 issued in U.S. Appl. No. 12/938,078.
United States Office Action dated Feb. 10, 2015 issued in U.S. Appl. No. 12/938,034.
United States Office Action dated Feb. 12, 2015 issued in U.S. Appl. No. 12/509,693.
United States Office Action dated Feb. 26, 2015 issued in U.S. Appl. No. 12/938,135.
United States Office Action dated Feb. 26, 2015 issued in U.S. Appl. No. 13/145,203.
United States Office Action dated Feb. 26, 2015 issued in U.S. Appl. No. 12/854,330.
European Search Report issued in Application No. 10812324.1 dated Jan. 21, 2015.
U.S. Final Office Action issued in U.S. Appl. No. 12/938,110 dated Mar. 16, 2015.
U.S. Office Action issued in U.S. Appl. No. 14/304,541 dated May 6, 2015.
Maytag Front Loading Automatic Washer, Use and Care Guide; Aug. 18, 2006; pp. 1-72.
European Search Report issued in Application No. 10808344.5 dated May 21, 2015.
European Search Report issued in Application No. 10808345.2 dated May 22, 2015.
U.S. Office Action issued in U.S. Appl. No. 12/854,263 dated Jun. 29, 2015.
European Search Report issued in Application No. 10808346.0 dated Jun. 1, 2015.
European Search Report issued in Application No. 10808348.6 dated Jun. 1, 2015.
U.S. Office Action issued in U.S. Appl. No. 12/938,034 dated Jul. 27, 2015.
U.S. Office Action issued in U.S. Appl. No. 12/938,110 dated Aug. 11, 2015.
U.S. Final Office Action issued in U.S. Appl. No. 13/145,203 dated Aug. 19, 2015.
U.S. Final Office Action issued in U.S. Appl. No. 13/392,597 dated Sep. 8, 2015.
Thompson; WPI Database; Thomson Scientific London, Great Britain; Great Britain; Week 200645; Abstract of KR 10-2005-0061701 dated Jun. 23, 2005 (previously submitted) (XP-002745090).
European Search Report issued in Application No. 10827181.8 dated Oct. 7, 2015.
European Search Report dated Oct. 8, 2015.
Chinese Office Action dated Dec. 4, 2015. (English Translation).
U.S. Office Action dated Dec. 16, 2015 issued in U.S. Appl. No. 12/938,034.
European Search Report dated Dec. 21, 2015.
U.S. Office Action dated Dec. 21, 2015 issued in U.S. Appl. No. 13/392,597.
U.S. Office Action issued in co-pending U.S. Appl. No. 13/145,203 dated Apr. 21, 2016.
U.S. Office Action issued in co-pending U.S. Appl. No. 12/854,263 dated Apr. 26, 2016.
U.S. Office Action issued in co-pending U.S. Appl. No. 12/938,034 dated May 5, 2016.
U.S. Office Action issued in co-pending U.S. Appl. No. 12/938,110 dated May 27, 2016.

* cited by examiner

WASHING MACHINE AND WASHING METHOD

This claims priority to Korean Application No. 10-2009-0027664 filed in Korea on Mar. 31, 2009, and Korean Application No. 10-2009-0087141 filed in Korea on Sep. 15, 2009 the entirety of which is incorporated herein by reference.

BACKGROUND

1. Field

This relates to a washing machine and associated washing method.

2. Background

Generally, a washing machine cleans laundry items by washing, rinsing, and spinning in order to separate dirt from the items using water, wash agents such as detergent, and a mechanical operation. An agitator type washing machine washes laundry items by rotating a washing rod positioned at the center of the washing tub in left and right directions. A pulsator type washing machine washes laundry using friction force between the laundry items and water current generated by a circular plate shaped pulsator formed in a lower portion of the washing tub. A drum type washing machine washes laundry items by rotating a drum containing washing water, wash agents and the laundry items.

In the drum type washing machine, a tub holding wash fluid therein is mounted within a cabinet, and a drum having the laundry items loaded therein is mounted within the tub, with a motor that rotates the drum being mounted at the rear of the tub. A drive shaft is axially connected to a rear side of the drum, passing through the tub. A lifter is mounted within the drum so as to lift laundry during a rotation of the drum. In such a drum type washing machine, laundry items are lifted by the lifter mounted inside the drum during rotation of the drum and then released from the inside of the drum and dropped as the drum rotates (referred to as tumbling).

BRIEF DESCRIPTION OF THE DRAWINGS

The embodiments will be described in detail with reference to the following drawings in which like reference numerals refer to like elements wherein.

DETAILED DESCRIPTION

Exemplary embodiments of a washing machine and washing method will be hereinafter described in detail with reference to the accompanying drawings.

Figure 1:
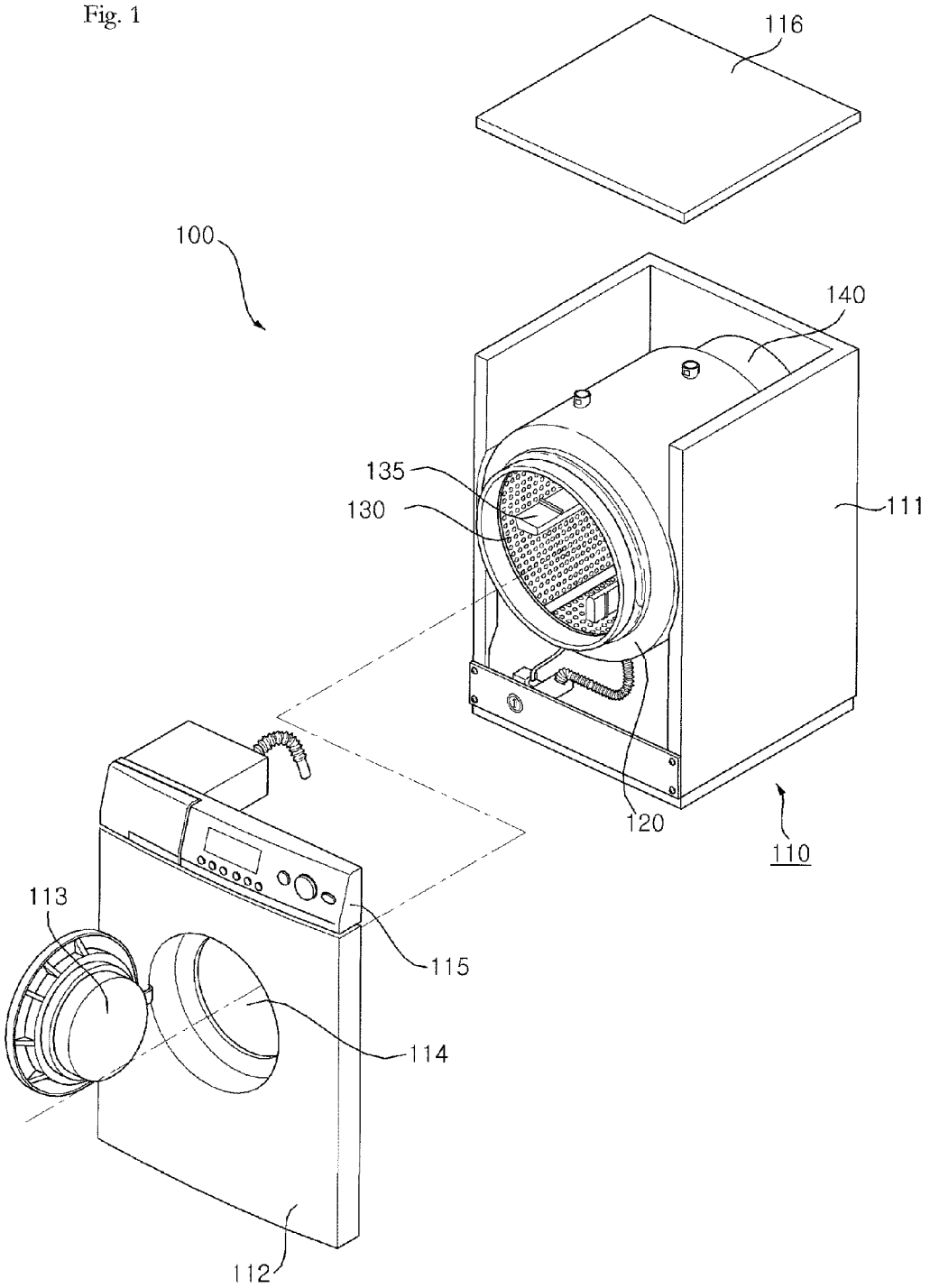
FIG. 1 is a perspective view of a washing machine according to an exemplary embodiment as broadly described herein.
Figure 2:
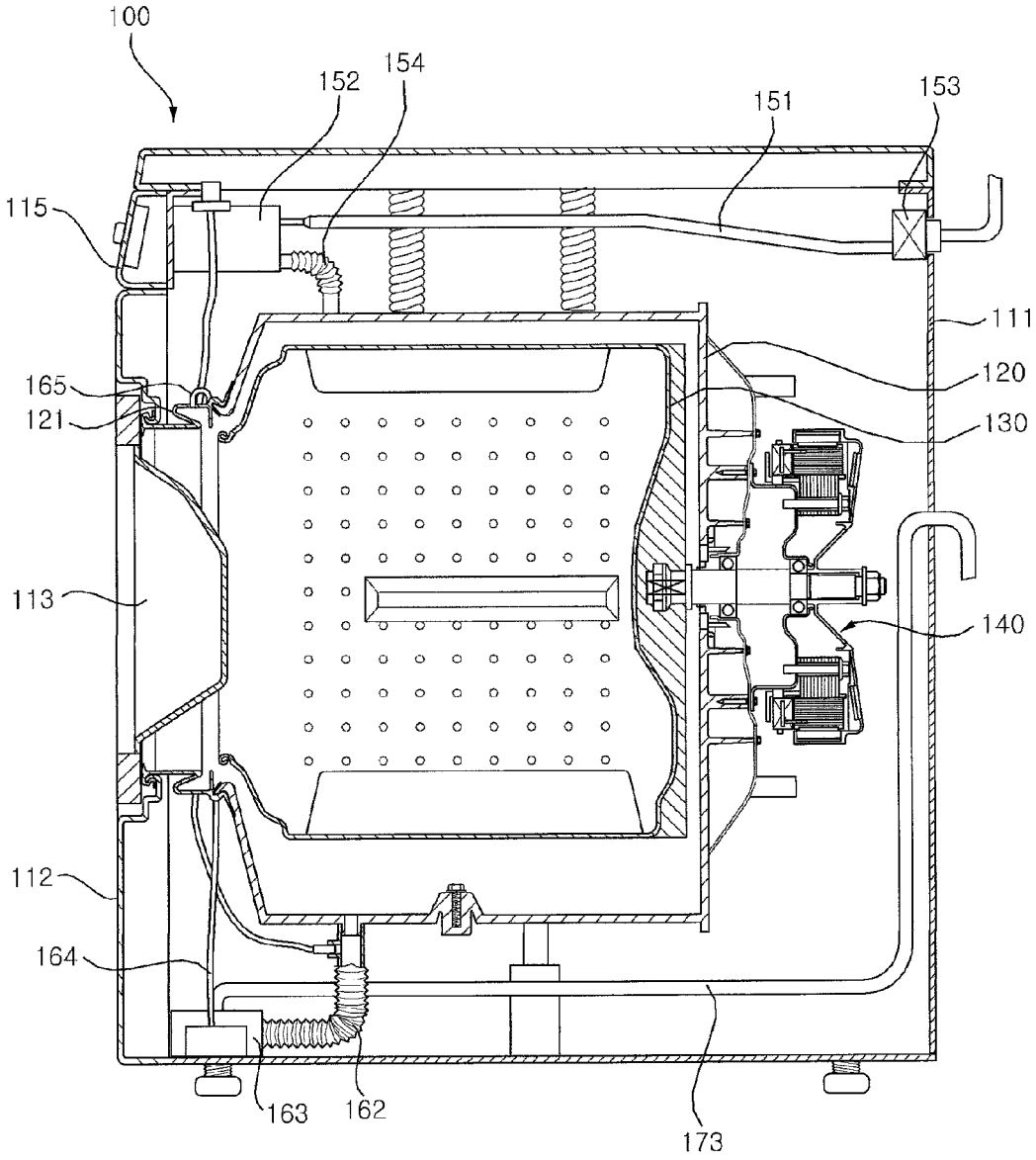
FIG. 2 is a side cross-sectional view of the washing machine shown in FIG. 1.

The exemplary washing machine 100 shown in FIGS. 1 and 2 may include a cabinet 110, a tub 120 installed in the cabinet 110, a drum 130 rotatably installed in the tub 120, a driver 140 for rotating the drum 130 by applying a torque to the drum 130, and a controller 115 for controlling an overall operation of the washing machine 100 in response to an external input.

The cabinet 110 may include a cabinet main body 111, a cabinet cover 112 coupled to a front surface of the cabinet main body 111, and a top plate 116 coupled to a top of the cabinet main body 111. The cabinet cover 112 may include a laundry entrance hole 114 and a door 113 rotatably coupled to the cabinet cover 112 so as to open and close the laundry entrance/exit hole 114.

The washing machine 100 may also include a gasket 121 disposed between the inlet of the drum 130 and the laundry entrance hole 114. The gasket 121 alleviates impact transferred to the door 113 during rotation of the drum 130 and also prevents washing fluid in the tub 120 from leaking out. The tub 120 installation in the cabinet 110 may be damped by springs and a damper.

The tub 120 contains washing fluid during operation of the washing machine 100. A plurality of holes for passing washing fluid therethrough may be formed in the drum 130, and a lifter 135 may be provided on an inner circumferential surface of the drum 130 so as to lift the laundry items by a predetermined height when the drum 130 rotates.

The driver 140 rotates the drum 130 within the tub 120. The driver 140 may include a motor and a switching element for controlling the motor. The driver 140 may implement various motions in response to inputs received by the controller 115.

A supply valve 153 may introduce washing fluid from an external source, and a supply hose 151 may guide the washing fluid from the supply valve to a detergent box 152, the detergent box 152 containing washing agents such as a laundry detergent, bleach, a fabric softener, and the like. A supply bellows 154 may introduce the washing fluid including a washing agent from the detergent box 152 into the drum 130. The supply valve 153, the supply hose 151, and the supply bellows 154 may be connected/coupled so as to form a fluid supply device.

The washing machine 100 may also include a discharge hose 162 for discharging washing fluid from the tub 120, a pump 163 for pumping the discharged the washing fluid, a circulation path 164 for guiding washing fluid to the drum 130, a nozzle 165 provided at the gasket for introducing the washing fluid into the drum 130, and a drain path 173 for guiding the washing fluid to an outside of the cabinet 110. The discharge hose 162, the pump 163, the circulation path 164, and the nozzle 165 may be coupled/connected so as to form a circulation device, and the discharge hose 162, the pump 163, and the drain path 173 may be coupled/connected so as to form a draining device. The discharge hose 162 and the pump 163 may be provided separately for the circulation device and the draining device, respectively.

The controller 115 may control an overall operation of the washing machine 100 in response to an external input, and may display a current operation state. The controller 115 may be provided at an upper portion of the cabinet cover 112. The controller 115 may be provided with a manipulation button for receiving a user input, a microcomputer for controlling the operation of the washing machine 100, and a display device such as an LCD display.

Figure 3A:
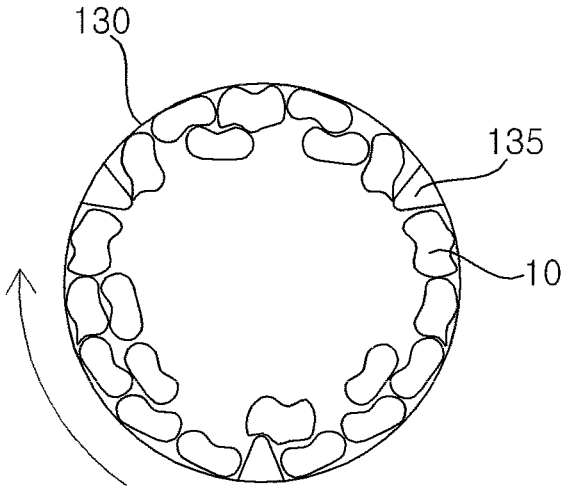
FIGS. 3A-3C illustrate a squeezing motion in a washing method according to an exemplary embodiment as broadly described herein.
Figure 3B:
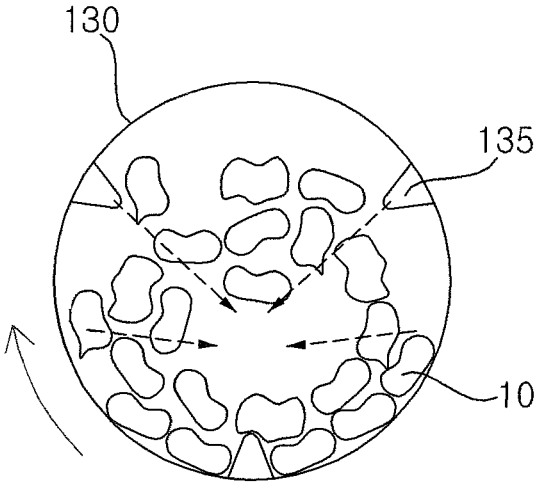
Figure 3C:
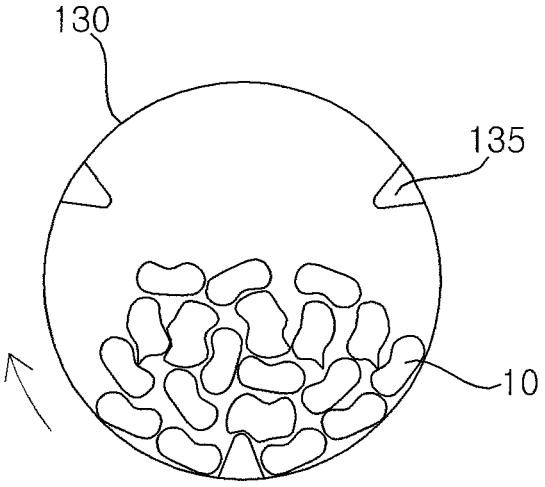

FIGS. 3A-3C illustrate a squeezing motion in a washing method as embodied and broadly described herein. In this method, a squeezing motion is a motion repeated in a short cycle in which the drum 130 is accelerated to a high speed during a wash cycle or rinse cycle. This acceleration causes laundry 10 in the drum 130 to rotate, clinging to or squeezing against the inner circumferential surface of the drum 130. The drum 130 is then decelerated to cause the laundry 10 to be separated or released from the inner circumferential surface of the drum 130.

More specifically, as shown in FIG. 3A, when the drum 130 rotates at a high speed, the laundry 10 in the drum 130 rotates, clinging to the inner circumferential surface of the drum 130. For example, the drum 130 may rotate to about 100 RPM to cause the laundry 10 to cling to the inner circumferential surface of the drum 130 due to centrifugal force. The drum 130 and laundry 10 therein may be rotated for an appropriate amount of time at an appropriate speed so that it is evenly distributed and clings to the inner circumferential surface of the drum 130.

At this time, washing fluid may be introduced from the supply bellows 154 or the nozzle 165 and evenly distributed onto the laundry 10. That is, washing fluid may be supplied from the outside during a squeezing motion in a laundry soaking step, or washing fluid may be circulated so as to evenly soak the laundry 10 during the squeezing motion in a rinsing or washing step.

As shown in FIG. 3B, when the drum 130 is decelerated, the laundry 10 is separated from the inner circumferential surface of the drum 130. When the drum 130 is decelerated to a speed at which little to no centrifugal force is applied to the laundry 10, the laundry 10 is separated due to gravity and the drum 130 continues to rotate, thus moving and mixing the laundry 10 uniformly. At this time, washing fluid may be introduced from the supply bellows 154 or the nozzle 165 and evenly distributed onto the laundry 10.

As shown in FIG. 3C, when the drum 130 is fully decelerated, the laundry 10 is gathered at the center of the drum 130. For example, when the drum 130 rotates at about 50 RPM, the laundry 10 is gathered at the center of the drum 130 and rolls over. As described above, washing fluid may be introduced from the supply bellows 154 or the nozzle 165 and evenly distributed onto the laundry 10.

Afterwards, the drum 130 is again accelerated in the same direction or a reverse direction so that the laundry 10 gathered at the center of the drum 130 as shown in FIG. 3C is rotated so as to evenly distribute the laundry 10 so that it clings to the inner circumferential surface of the drum 130, as shown in FIG. 3A. If the direction is reversed, the drum 130 will rotate counter-clockwise in FIG. 3A.

In certain embodiments, each of the steps 3A-3C may be repeated in short cycle. In certain embodiments, a cycle time in which acceleration and deceleration may be repeated may be, for example, 1 to 4 seconds, and a time to accelerate from about 50 rpm to about 100 rpm may be about 2 seconds, and in certain circumstances about 1.2 seconds. A time to decelerate from about 100 rpm to about 50 rpm may be about 1 second, and in certain circumstances about 0.5 seconds. Each of the acceleration and deceleration is repeated at least twice.

FIGS. 4A-4E illustrate various drum motions of a washing machine and associated washing method as embodied and broadly described herein.

Figure 4A:
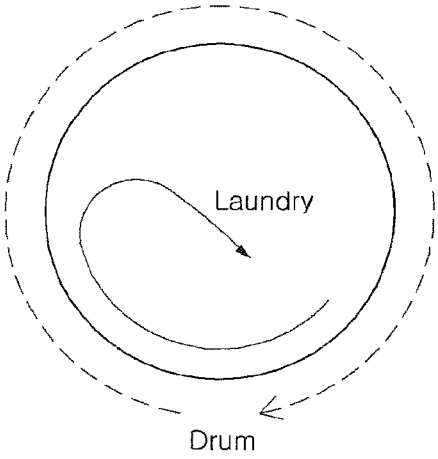
FIGS. 4A-4E illustrate various drum motions of the washing machine and associated method as embodied and broadly described herein.

In FIG. 4A, the driver 140 rotates the drum 130 in a predetermined direction so that the laundry is lifted from the lowest position of the drum 130 and is chopped in the vicinity of half the vertical height of the drum 130 (hereinafter, referred to as "tumbling motion"). In certain embodiments, the drum 130 may continuously rotate at about 45 rpm in the tumbling motion, and the laundry in the drum 130 is washed by impact and frictional force.

Figure 4B:
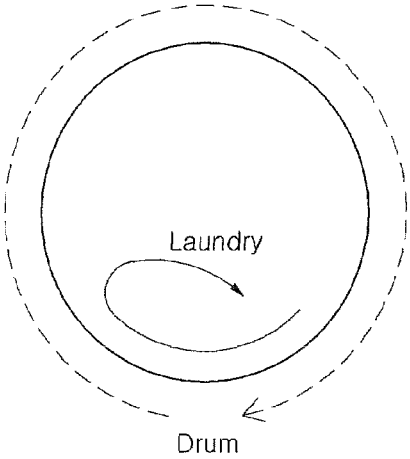

In FIG. 4B, the driver 140 rotates the drum 130 in a predetermined direction so that the laundry is lifted from the lowest position of the drum 130 and is dropped at a height of less than half the vertical height of the drum (hereinafter, referred to as "rolling motion"). In certain embodiments, the drum 130 may continuously rotate at about 40 rpm or below in the rolling motion, and the laundry in the drum 130 is washed by bending and stretching force and frictional force by being dropped and rolling over each other/itself.

Figure 4C:
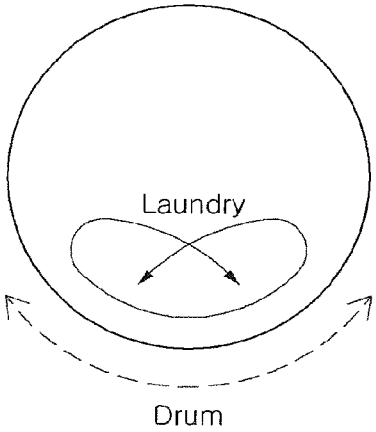

In FIG. 4C, the driver 140 rotates the drum 130 in different directions so that the laundry is lifted from the lowest position of the drum 130 and dropped in the vicinity of half the height of the drum 130 (hereinafter, referred to as "swing motion"). In certain embodiments, the drum 130 rotates at about 40 rpm or below in different directions in the swing motion. The laundry in the drum 130 is washed by bending and stretching force and frictional force by being dropped and rolling over each other/itself.

Figure 4D:
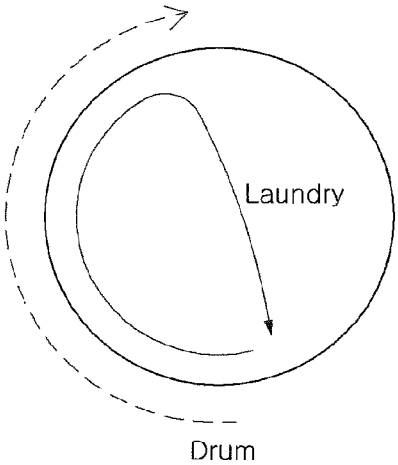

In FIG. 4D, the driver 140 rotates the drum 130 in a predetermined direction so that the laundry is lifted from the lowest position of the drum and dropped in the vicinity of the top of the drum 130 (hereinafter, referred to as "step motion"). In certain embodiments, the drum 130 may be rotated at about 60 rpm or above to raise the laundry in the step motion. The laundry is raised higher than half the height of the drum 130 and then the driver 140 controls the drum 130 so that the laundry is dropped in the vicinity of the top of the drum 130. After the laundry is dropped, the drum 130 raises the laundry by rotating in the same direction again. The laundry in the drum 130 is washed by a high impact force using a head of washing fluid.

Figure 4E:
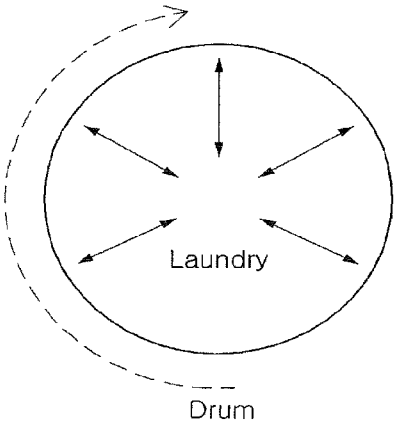

In FIG. 4E, the driver 140 changes the speed of the drum 130 in short cycle so that the laundry is gathered and distributed in a repeated manner. In certain embodiments, the speed of the drum 130 in the squeezing motion may be changed in short cycle within a speed range of about 50 to 100 rpm to cause the laundry to be alternately drawn toward and separated from the inner circumferential surface of the drum 130 in a repeated manner. As the movement of the laundry is facilitated, washing deviation may be reduced and the laundry may be brought into uniform contact with the washing fluid. In addition, when the laundry clings to the inner circumferential surface of the drum 130, the washing fluid that has soaked through the laundry may be discharged through the holes in the drum 130 as if being squeezed out of the laundry. Therefore, contaminants on the laundry may be discharged during washing as if being squeezed out, and a detergent remaining on the laundry may also be discharged as if being squeezed out. Moreover, as the laundry is repeatedly drawn toward and separated from the inner circumferential surface of the drum 130, the user may visually check the movement of the laundry.

Figure 5:
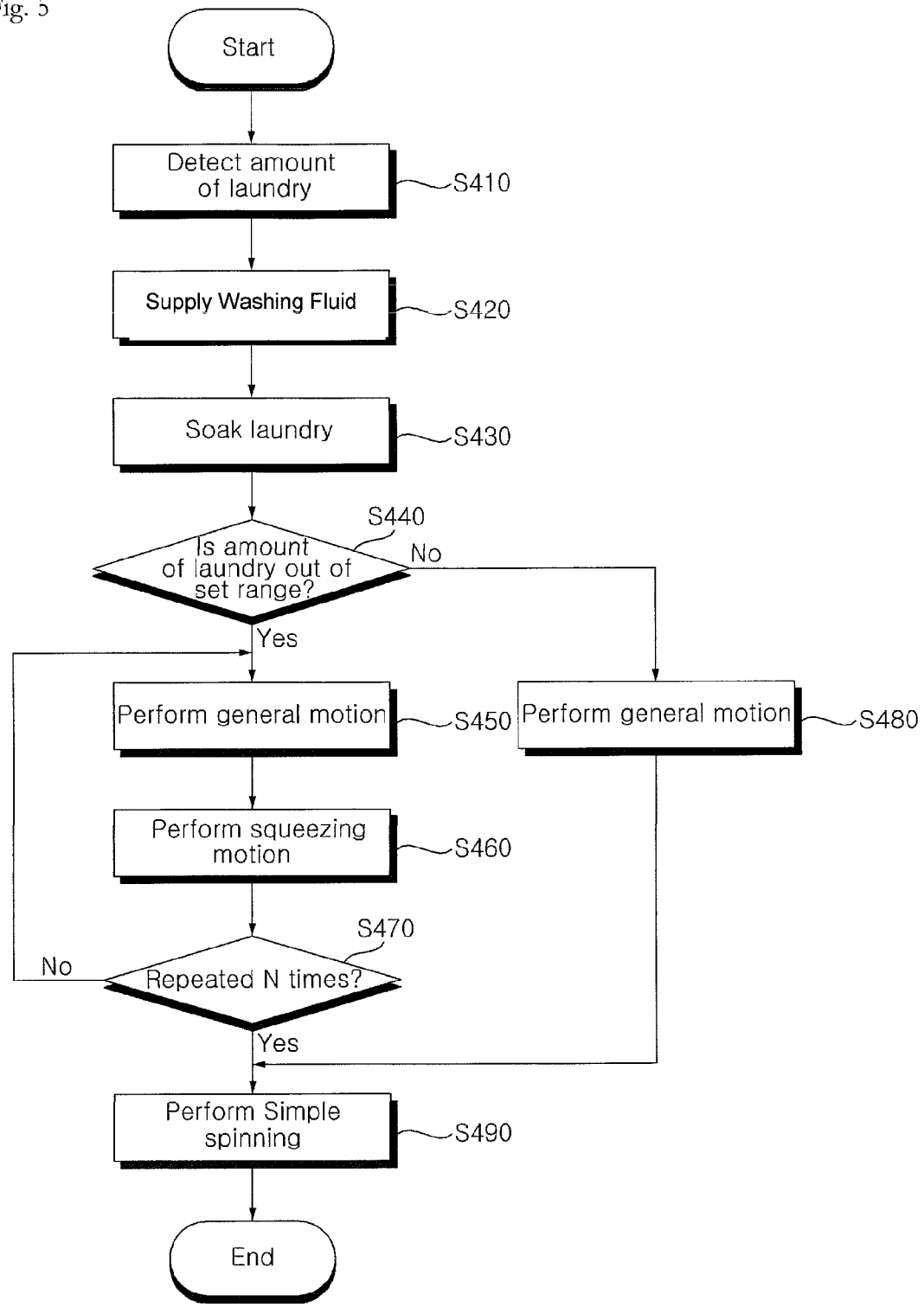
FIG. 5 is a flow diagram of a washing method according to an exemplary embodiment as broadly described herein.

FIG. 5 illustrates a washing method according to an exemplary embodiment as broadly described herein.

When washing is started, an amount of laundry contained in the drum 130 is detected (S410). A washing course is selected through manipulation of a button of the controller 115 and the microcomputer of the controller 115 starts the corresponding washing course and detects the amount of laundry in the drum 130.

The detection of the amount of laundry in the drum 130 may be implemented by various methods or devices. In one exemplary embodiment, the driver 140 rotates the drum 130 at a predetermined speed for a predetermined period of time and then measures a deceleration time to detect the amount of laundry in the drum 130. The longer the deceleration time of the drum 130, the greater the amount of laundry in the drum 130. The amount of laundry may be calculated by the microcomputer of the controller 115, or other means as appropriate.

An initial supply of washing fluid is then provided (S420). When the supply valve 153 is opened and washing fluid is supplied from the external source, the washing fluid is guided to the detergent box 152 along the supply hose 151 is mixed with a washing agent, and is introduced into the drum 130 by the supply bellows 154.

Upon completion of the washing fluid supply or during the washing fluid supply, laundry soaking is performed (S430). During laundry soaking, laundry is moved so that the laundry contained in the drum 130 may be soaked by the washing fluid supplied to the inside of the tub 120. In general, laundry soaking is performed by a tumbling motion, but may also be performed by the above-described squeezing motion. If laundry soaking is performed by the squeezing motion, washing fluid may be introduced from the supply bellows 154 and/or the nozzle 165 and evenly distributed onto the laundry.

It is then determined whether or not the amount of laundry is out of a set range (S440). More specifically, it is determined whether a detected amount of laundry is greater than a predetermined level so as to determine whether to perform a drum motion in the wash cycle.

If the amount of laundry is out of the set range, a general motion may be performed (S450), and the squeezing motion may be performed (S460). The general motion refers to a rolling motion, a swing motion, and a step motion, as well as the tumbling motion discussed above with respect to FIGS. 4A-4D.

If the general motion is repeated when the amount of laundry is large, the laundry may become entangled, thus hindering or preventing movement of the laundry. Accordingly, the general motion may be performed for a predetermined period of time, and then the squeezing motion may be performed. If the amount of laundry is small, the laundry may cling to the inner circumferential surface of the drum 130 even at a low rpm, thus hindering the squeezing motion.

The squeezing motion changes the speed of the drum 130 in short cycle to move the laundry by repeatedly gathering and spreading the laundry. As the movement of the laundry is facilitated, washing deviation may be reduced and the laundry may be brought into uniform contact with the washing fluid. In addition, when the laundry clings to the inner circumferential surface of the drum 130, the washing fluid soaked through the laundry may be discharged through the holes in the drum 130 as if being squeezed out of the laundry. Therefore, contaminants on the laundry may be discharged during washing as if being squeezed out, and wash agents remaining on the laundry may be discharged as if being squeezed out. Moreover, as the laundry is repeatedly drawn to and separated from the inner circumferential surface of the drum 130, the user may visually check the movement of the laundry.

In certain embodiments, execution time of the squeezing motion during a wash cycle may be about 10 minutes. However, this may differ according to the amount of laundry being washing and/or a particular washing course selected.

In the squeezing motion, the washing fluid may be circulated to evenly soak the laundry. At the time of the squeezing motion, the pump 163 may be operated so that washing fluid discharged to the discharge hose 162 is circulated along the circulation path 164 and introduced into the drum 130 through the nozzle 165.

It is then determined how many times N the general motion and the squeezing motion are repeated (S470). The general motion and the squeezing motion may be performed N times so as to reduce/eliminate washing deviation by virtue of the movement of the laundry. The number of times N the general motion and squeezing motion are repeated may be varied according to a selected course and an amount of laundry.

After the general motion and the squeezing motion are repeated N times, simple spinning is performed (S490) so that the washing fluid used in washing may be discharged to an outside of the washing machine.

If the amount of laundry in the drum 130 is within the set range (S440), the general motion is performed (S480), and the simple spinning is performed (S490).

If the above-described process leading up to the simple spinning step S490 is a general wash cycle, after simple spinning (S490), the supply step (S420) may be performed again to initiate a rinse cycle. The washing fluid supplied at this time may be water or water mixed with a fabric softener or the like.

In certain embodiments, execution time of the squeezing motion during the rinse cycle may be about 3 minutes. However, this may differ according to the amount of laundry in the drum 130 and/or a particular washing course selected. The above-described steps may be repeated in the rinse cycle. However, the operation time of each step and the repeated number of times N may be changed as appropriate.

Figure 6:
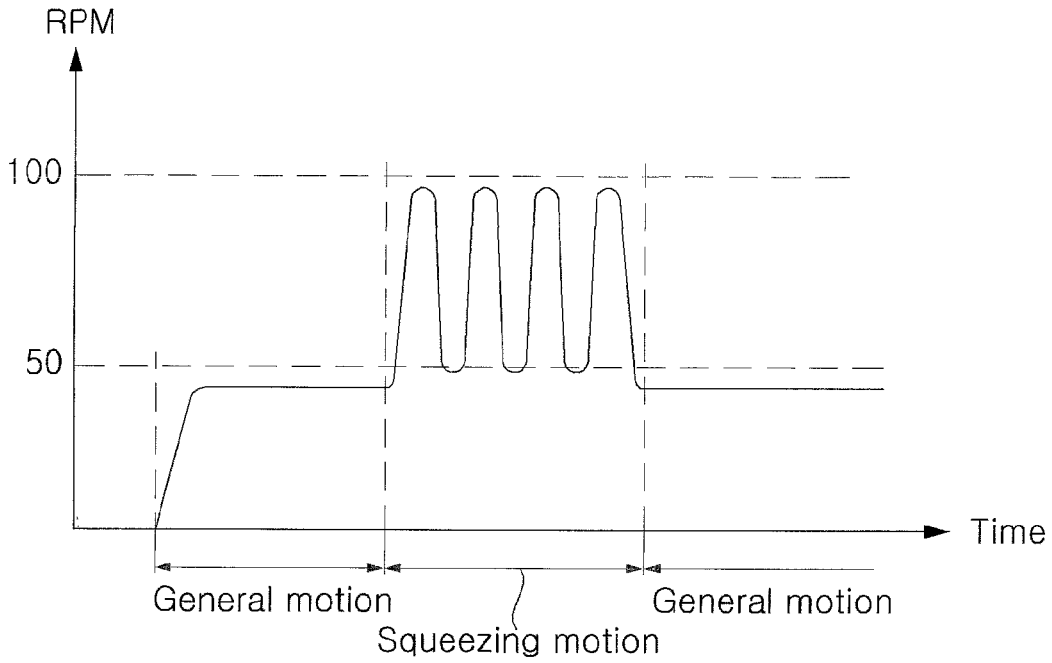
FIG. 6 is a graph of rotation speed of the drum with respect to time.

FIG. 6 is a graph of rotation speed of the drum with respect to time in the washing method according to the exemplary embodiment as broadly described herein. In particular, FIG. 6 illustrates an example in which a general motion is a tumbling motion. In such a general motion, the drum 130 may continuously rotate at about 45 rpm. In the squeezing motion, the speed of the drum 130 may be changed in short cycle within a speed range of about 50 to 100 rpm.

Cycle time in which acceleration and deceleration are repeated may be between about 1 to 4 seconds. Time to accelerate from 50 rpm to 100 rpm may be 2 seconds, and, in certain embodiments, about 1.2 seconds. Time to decelerate from 100 rpm to 50 rpm may be about 1 second and, in certain embodiments, about 0.5 seconds.

In the wash cycle or the rinse cycle, the general motion and the squeezing motion may be repeated as appropriate.

It will be understood by those skilled in the art that example embodiments can be implemented in other specific forms without changing the technical spirit or essential features of the present invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

In a washing machine and washing method as embodied and broadly described herein, in the washing or rinsing of a large amount of laundry, the laundry is brought into good, uniform contact with washing fluid, thereby improving washing performance.

In a washing machine and washing method as embodied and broadly described herein, the movement of laundry is facilitated, thereby reducing washing deviation in the washing or rinsing of a large amount of laundry.

In a washing machine and washing method as embodied and broadly described herein, contaminants on the laundry may be discharged as if being squeezed out, thereby improving washing performance.

In a washing machine and washing method as embodied and broadly described herein, detergent remaining on the laundry may be discharged as if being squeezed out, thereby improving rinsing performance.

In a washing machine and washing method as embodied and broadly described herein, a user may visually check the movement of the laundry.

A washing machine and associated washing method which can improve washing performance are provided.

A washing machine and associated washing method which can uniformly mix laundry during a wash cycle or a rinse cycle are provided.

A washing machine and associated washing method which can allow laundry to be brought into uniform contact with washing water during a wash cycle or a rinse cycle are provided.

A washing method according to an exemplary embodiment as broadly described herein may include supplying washing water into a drum containing laundry; repeatedly dropping the laundry while rotating the drum in a predetermined direction; and sticking or separating the laundry to and from the inside of the drum by repeatedly accelerating and decelerating the drum.

A washing method according to another exemplary embodiment as broadly described herein may include rotating a drum to cause the laundry in the drum to be rotated, clinging to the inside of the drum, in a wash cycle or rinse cycle of a drum type washing machine; decelerating the drum to separate the laundry from the inside of the drum; and accelerating the drum to cause the laundry to be rotated, clinging to the inside of the drum.

A washing machine according to an exemplary embodiment as broadly described herein may include a drum which holds laundry and rotates; a drive unit for rotating the drum; and a control unit for performing a general motion in which the drive unit repeatedly drops the laundry by rotating the drum in a predetermined direction in a wash cycle or rinse cycle and a squeezing motion in which the drive unit sticks and separates the laundry to and from the inside of the drum by accelerating and decelerating the drum.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of operating a washing machine, the method comprising a first motion and a second motion, wherein the first motion includes:

rotating a drum in a first direction to draw laundry items disposed in the drum toward an inner circumferential surface of the drum such that the laundry items cannot be separated from the inner circumferential surface of the drum during the rotation of the drum;

braking the rotation of the drum when the laundry items are lifted to a height higher than half the height of the drum to drop the laundry items at the height greater than half the height of the drum; and repeating the rotating the drum in the first direction and braking the rotation of the drum, wherein the rotating the drum in the first direction, the braking the rotation of the drum, and the repeating the rotating the drum in the first direction are performed sequentially, and wherein the second motion includes:

accelerating a rotation of the drum in one of the first direction or a second direction to draw the laundry items toward the inner circumferential surface of the drum;

decelerating the rotation of the drum to allow the laundry items to fall from the inner circumferential surface of the drum due to gravity; and repeating the accelerating the rotation of the drum and the decelerating the rotation of the drum for a prescribed number of times greater than one, wherein the accelerating the rotation of the drum further includes:

spraying washing fluid into the drum as the laundry items are drawn toward the inner circumferential surface of the drum; and discharging the washing fluid sprayed into the drum through a plurality of holes provided in a cylindrical surface of the drum when the laundry items are compressed against the inner circumferential surface of the drum.

2. The method of claim 1, wherein the drum is rotated at a speed to cause the laundry items to cling to the inner circumferential surface of the drum due to a centrifugal force in the accelerating the rotation of the drum.

3. The method of claim 1, wherein the drum is decelerated at a speed to cause the laundry items to roll over in the decelerating the rotation of the drum.

4. The method of claim 1, further comprising:

supplying the washing fluid into the drum before the accelerating the rotation of the drum.

5. The method of claim 1, wherein the accelerating the rotation of the drum and the decelerating the rotation of the drum are performed during at least one of a washing cycle or a rinsing cycle.

6. The method of claim 1, wherein the decelerating the rotation of the drum further includes spraying the washing fluid into the drum as the laundry items are released from the inner circumferential surface of the drum.

7. The method of claim 1, further including detecting an amount of the laundry items in the drum, wherein the accelerating the rotation of the drum and the decelerating the rotation of the drum are performed if the detected amount of the laundry items is outside of a predetermined range.

8. The method of claim 1, wherein the spraying the washing fluid into the drum supplies water mixed with at least one washing agent while repeatedly and alternately accelerating and decelerating the rotation of the drum during a washing operation.

9. The method of claim 8, wherein the spraying the washing fluid into the drum supplies clean water while repeatedly and alternately accelerating and decelerating the rotation of the drum during a rinsing operation.

10. A washing machine, comprising:

a rotatable drum configured to receive laundry items therein, wherein the drum has a plurality of holes provided in a cylindrical surface of the drum;

a driver that rotates the drum;

a controller that controls the driver so as to perform a first motion in which the driver rotates the drum in only a first direction during a wash cycle or a rinse cycle so as to repeatedly elevate and drop the laundry items at a height greater than half the height of the drum, and a second motion in which the driver alternately accelerates and decelerates the drum so as to alternately draw the laundry items toward and release the laundry items from an inner circumferential surface of the drum; and a supply device that supplies washing fluid into the drum during the second motion, wherein the supply device sprays the washing fluid onto the laundry items as the laundry items are drawn toward the inner circumferential surface of the drum so that the washing fluid sprayed into the drum is discharged through the plurality of holes in the drum when the laundry items are compressed against the inner circumferential surface of the drum, wherein the first motion includes:

rotating the drum in the first direction to draw the laundry items toward an inner circumferential surface of the drum such that the laundry items cannot be separated from the inner circumferential surface of the drum during the rotation of the drum;

braking the rotation of the drum when the laundry items are lifted to a height higher than half the height of the drum to drop the laundry items at the height greater than half the height of the drum; and repeating the rotating the drum in the first direction and the braking the drum, wherein the rotating the drum in the first direction, the braking the rotation of the drum, and the repeating the rotating the drum in the first direction are performed sequentially.

11. The washing machine of claim 10, wherein the supply device includes a circulation device that circulates the washing fluid into the drum during the second motion.

12. The washing machine of claim 10, wherein the controller controls the driver to repeatedly and alternately accelerate and decelerate the drum during the second motion.

13. The washing machine of claim 12, wherein the driver accelerates the drum for 1.2 to 2.0 seconds, and decelerates the drum for 0.5 to 1.0 second.

14. The washing machine of claim 10, wherein if an amount of the laundry items in the drum is out of a predetermined range, the second motion is performed.

15. The washing machine of claim 10, wherein the controller controls the driver to repeatedly and alternately perform the first motion and the second motion.

16. The washing machine of claim 10, wherein in the second motion, contaminants in the laundry items are removed in the wash cycle.

17. The washing machine of claim 10, wherein in the second motion, wash agents in the laundry items are removed in the rinse cycle.

18. The washing machine of claim 10, wherein the second motion is a squeezing motion that compresses the laundry items.

19. A method of operating a washing machine, the method comprising a first motion and a second motion, wherein the first motion includes:

rotating a drum in a first direction to draw laundry items disposed in the drum toward an inner circumferential surface of the drum such that the laundry items cannot be separated from the inner circumferential surface of the drum during the rotation of the drum;

braking the rotation of the drum when the laundry items are lifted higher than half a height of the drum to drop the laundry items at the height greater than half the height of the drum; and repeating the rotating the drum in the first direction and the braking the rotation of the drum, wherein the rotating the drum in the first direction, the braking the rotation of the drum, and the repeating the rotating the drum in the first direction are performed sequentially, and wherein the second motion includes:

accelerating a rotation of the drum in one of the first direction or a second direction to draw the laundry items toward the inner circumferential surface of the drum;

decelerating the rotation of the drum to allow the laundry items to fall from the inner circumferential surface of the drum due to gravity; and repeating the accelerating the rotation of the drum and the decelerating the rotation of the drum for a prescribed number of times greater than one.

* * * * *